US007793642B2

(12) United States Patent
Yonemoto et al.

(10) Patent No.: US 7,793,642 B2
(45) Date of Patent: Sep. 14, 2010

(54) FUEL SUPPLY APPARATUS

(75) Inventors: Toshiyuki Yonemoto, Nagoya (JP); Yoshihiko Ooya, Takahama (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/434,715

(22) Filed: May 4, 2009

(65) Prior Publication Data

US 2009/0277424 A1 Nov. 12, 2009

(30) Foreign Application Priority Data

May 6, 2008 (JP) ..... 2008-120824

(51) Int. Cl.
*F02M 37/04* (2006.01)

(52) U.S. Cl. ..... 123/514; 123/506; 123/509

(58) Field of Classification Search ..... 123/506, 123/509, 511, 514
See application file for complete search history.

(56) References Cited

U.S. PATENT DOCUMENTS 6,341,623 B1 * 1/2002 Channing ..... 137/565.22
7,343,901 B2 * 3/2008 Mori et al. ..... 123/446
7,594,499 B2 * 9/2009 Suzuki et al. ..... 123/446
2008/0149074 A1 * 6/2008 Voelker ..... 123/511
2009/0165752 A1 * 7/2009 Yonemoto ..... 123/506
2009/0223492 A1 * 9/2009 Leppert ..... 123/509

FOREIGN PATENT DOCUMENTS

| | | |
|---|---|---|
| EP | 0 819 844 | 1/1998 |
| EP | 1 319 821 | 6/2003 |
| JP | 57-156068 | 9/1982 |
| JP | 2003-176761 | 6/2003 |

* cited by examiner

*Primary Examiner*—Hai H Huynh
(74) *Attorney, Agent, or Firm*—Nixon & Vanderhye PC

(57) ABSTRACT

In a fuel supply apparatus, a fuel pump draws fuel from a fuel tank, and discharges the fuel to a high-pressure fuel system. A filter unit has a filter element located on a downstream side of the fuel pump to remove foreign matters contained in the fuel discharged from the fuel pump. A jet pump has a nozzle that is installed in a fuel supply passage between the fuel pump and the filter element. The nozzle injects the fuel to a downstream side of the nozzle in the fuel supply passage. The introducing passage introduces excessive fuel from the high-pressure fuel system to the downstream side of the nozzle.

16 Claims, 8 Drawing Sheets

FUEL SUPPLY APPARATUS

CROSS REFERENCE TO RELATED APPLICATION

This application is based on and incorporates herein by reference Japanese Patent Application No. 2008-120824 filed on May 6, 2008.

BACKGROUND OF THE INVENTION

1. Field of the Invention

The present invention relates to a fuel supply apparatus for supplying fuel to an internal combustion engine.

2. Description of Related Art

JP2003-176761A, which corresponds to EP1319821A2, discloses a fuel supply apparatus. The fuel supply apparatus is located between a fuel tank and a diesel engine (hereafter referred to just as an engine). The fuel supply apparatus supplies fuel from the fuel tank through a fuel filter to constituents of a high-pressure fuel system, which include a common rail and fuel injection valves. The fuel supply apparatus returns excessive fuel (hereafter referred to as return fuel) from the constituents of the high-pressure fuel system to the fuel tank. This kind of fuel supply apparatus has a low-pressure fuel feed pump (hereafter referred to as a feed pump) and a high-pressure fuel supply pump. The feed pump draws up the fuel from the fuel tank and preliminarily pressurizes the fuel. The high-pressure fuel supply pump further pressurizes the fuel preliminarily pressurized by the feed pump. The above-mentioned return fuel is relatively hot. Therefore, the return fuel is returned to the fuel tank and is cooled by the fuel in the fuel tank.

As a type of the above-mentioned fuel supply apparatus, the fuel supply apparatus disclosed in JP2003-176761A has an introducing passage in a fuel circuit, which has a fuel filter on an upstream side of the feed pump. The introducing passage introduces the return fuel from the constituents of the high-pressure fuel system to an inlet side of the fuel filter. In this fuel supply apparatus, the fuel filter is located on the upstream side of the feed pump. Therefore, it is possible to introduce the relatively hot return fuel to the fuel filter with reliability, by using a pressure difference between pressure of the fuel at the inlet side of the fuel filter, which is generally a negative pressure, and pressure of the return fuel, which is approximately equal to atmospheric pressure.

JP57-156068U discloses another kind of fuel supply apparatus. This fuel supply apparatus has an electric heater on an inlet side of the fuel filter, that is, in a fuel passage between the fuel filter and the fuel tank.

EP0819844A2 discloses still another kind of fuel supply apparatus. This fuel supply apparatus has an introducing passage in a fuel circuit, which has a fuel filter on a downstream side of the feed pump. The introducing passage introduces the return fuel to an inlet side of the fuel filter. In this fuel supply apparatus, pressure of the fuel at the inlet side of the fuel filter is generally a positive pressure. This fuel supply apparatus aims to introduce the return fuel to the inlet side of the fuel filter where the pressure of the fuel is a positive pressure.

The inventors of the present invention have studied a possibility of locating the fuel filter on the downstream side of the feed pump in order to raise the pressure of the fuel that acts on the fuel filter. If an engine is started in a relatively low-temperature condition, viscosity of the fuel is high, and wax can precipitate out of the fuel. Therefore, clogging of precipitated wax (hereafter referred to just as wax clogging) can occur in the fuel filter. If the fuel filter is located on the downstream side of the feed pump, the fuel is pressure-fed through the fuel filter by the raised fuel pressure, and it is possible to delay occurrence of the wax clogging. However, there is an apprehension that the wax clogging can occur sooner or later.

In this regard, the fuel supply apparatus disclosed in JP2003-176761A may be applied to this kind of fuel circuit, which has the fuel filter on a downstream side of the feed pump. However, the pressure of the fuel at the inlet side of the fuel filter does not become lower than the pressure of the return fuel. Accordingly, the fuel supply apparatus of JP2003-176761A cannot be realized when it is applied the fuel circuit that has the fuel filter on the downstream side of the feed pump.

If the fuel supply apparatus disclosed in JP57-156068U is applied to the fuel circuit that has the fuel filter on the downstream side of the feed pump, it is possible to avoid the wax clogging in the fuel filter. However, this case requires an electric heater, and parts and electrical wirings become necessary to form a heat source on the inlet side of the fuel filter. Therefore, a cost of the fuel supply apparatus is considerably increased.

If the fuel supply apparatus disclosed in EP0819844A2 is applied to the fuel circuit that has the fuel filter on the downstream side of the feed pump, it is necessary to keep the pressure of the return fuel higher than the pressure of the fuel at the inlet side of the fuel filter. In this case, the pressure of the return fuel acts on a discharge side of the feed pump as a back pressure. Therefore, the pressure of the return fuel can lower discharge efficiency of the feed pump and can upsize the feed pump in some cases.

SUMMARY OF THE INVENTION

The present invention is made in view of the above-mentioned problem. Thus,it is an objective of the present invention to provide a fuel supply apparatus that can keep fuel on an inlet side of a fuel filter at a positive pressure and can avoid wax clogging in the fuel filter.

To achieve the objective of the present invention, there is provided a fuel supply apparatus for supplying fuel from a fuel tank to a high-pressure fuel system. The high-pressure fuel system accumulates the fuel at a high pressure, supplies the fuel to an internal combustion engine at the high pressure, and returns excessive fuel, which is a part of the fuel that is once accumulated in the high-pressure fuel system yet not supplied to the internal combustion engine, to the fuel tank. The fuel supply apparatus has a fuel pump, a filter unit, a jet pump and an introducing passage. The fuel pump draws the fuel from the fuel tank, and discharges the fuel to the high-pressure fuel system. The filter unit has a filter element located on a downstream side of the fuel pump to remove foreign matters contained in the fuel discharged from the fuel pump. The jet pump has a nozzle installed in a fuel supply passage between the fuel pump and the filter element to inject the fuel to a downstream side of the nozzle in the fuel supply passage. The introducing passage introduces the excessive fuel from the high-pressure fuel system to the downstream side of the nozzle.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF PREFERRED EMBODIMENTS

Figure 1:
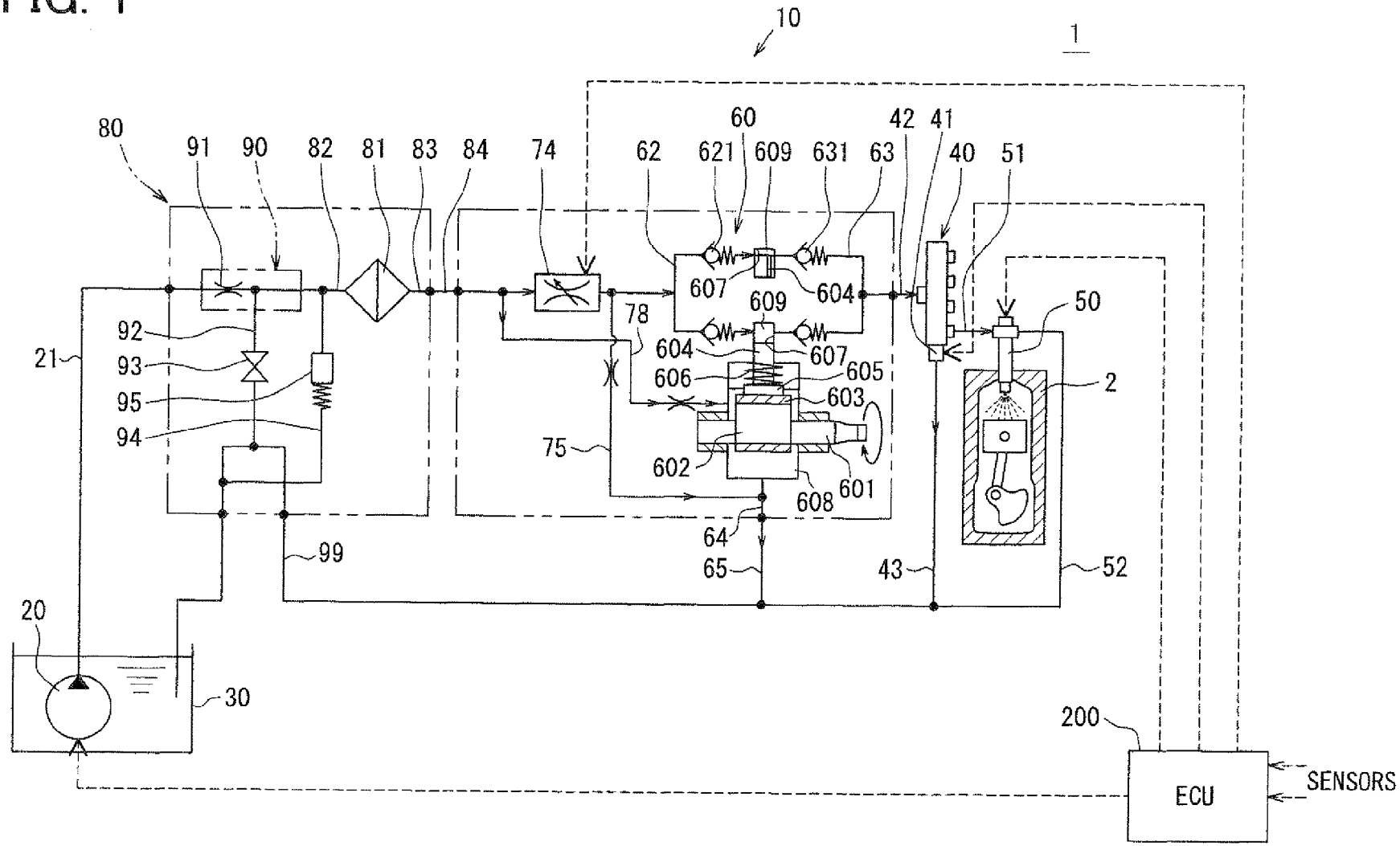
FIG. 1 is a schematic diagram showing a construction of an accumulator fuel injection apparatus that includes a fuel supply apparatus according to a first embodiment of the present invention.

Embodiments of the present invention will be described hereafter with reference to accompanying drawings. Elements that correspond to each other across the embodiments are assigned with the same reference numerals, and are not described repeatedly.

First Embodiment

Figure 7A:
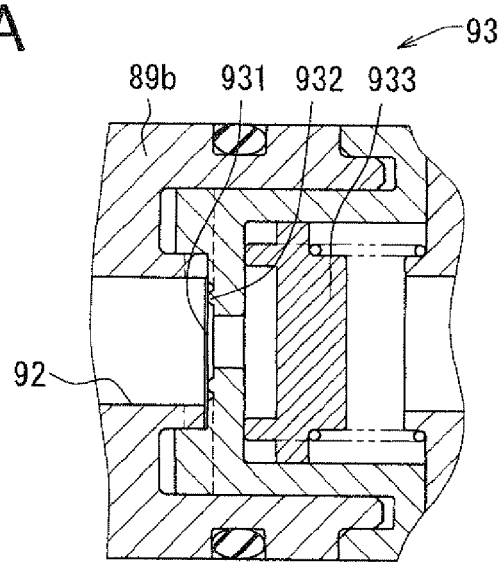
FIG. 7A is a cross-sectional view showing an open/close means in FIG. 5, which is in a closed state.
Figure 7B:
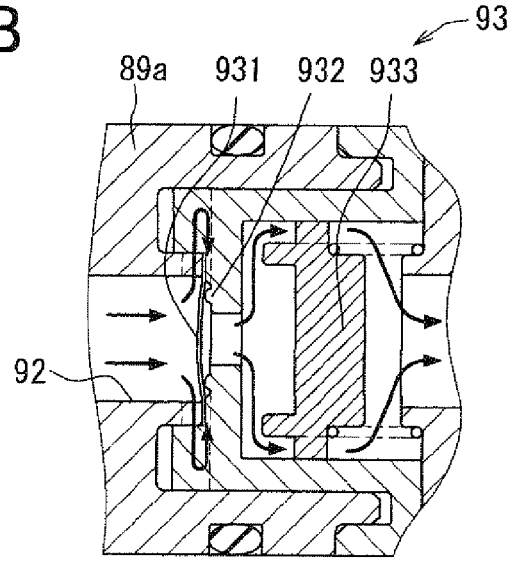
FIG. 7B is a cross-sectional view showing the open/close means in FIG. 5, which is in an opened state.
Figure 8:
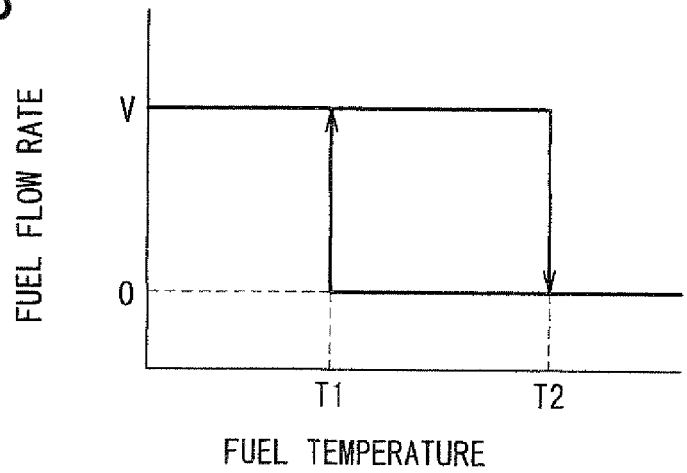
FIG. 8 is a graph schematically showing an open/close characteristic of the open/close means in FIG. 5.

FIGS. 1-8 show a fuel supply apparatus according to a first embodiment of the present invention. FIG. 1 shows an entire construction of an accumulator fuel injection apparatus for a diesel engine (hereafter referred to just as an engine), which includes the fuel supply apparatus according to the first embodiment. FIGS. 2-8 show characteristic constructions of the fuel supply apparatus according to the first embodiment. FIGS. 3-7 show a jet pump, an open/close means and a fuel flow rate adjusting device in a filter unit. FIG. 8 schematically shows an open/close characteristic of the open/close means.

As shown in FIG. 1, the accumulator fuel injection apparatus 1 is a system for injecting fuel into cylinders (four cylinders in this embodiment) of the engine 2. The accumulator fuel injection apparatus 1 includes a common rail 40, fuel injection valves 50, the fuel supply apparatus 10 and a control circuit 200. The common rail 40 accumulates high-pressure fuel therein. The fuel injection valves 50 inject the high-pressure fuel, which is supplied from the common rail 40, into the cylinders of the engine 2. The fuel supply apparatus 10 supplies fuel to the common rail 40. The control circuit 200 controls operations of the fuel supply apparatus 10 and the fuel injection valves 50. Thereby, the control circuit 20 controls discharge quantity of the fuel supply apparatus 10 and injection quantity of the fuel injection valves 50 in accordance with running state of the engine 2.

The common rail 40 receives the high-pressure fuel that is supplied from a high-pressure fuel supply pump 60, and accumulates the high-pressure fuel at a target common rail pressure, which corresponds to a fuel injection pressure. The target common rail pressure is set by the control circuit 200 on a basis of the running state (an accelerator opening degree and an engine speed, for example) of the engine 2. The common rail 40 is provided with a pressure reducing valve 41 that releases a part of the fuel in the common rail 40. Signals from the control circuit 200 control an operation of the pressure reducing valve 41 separately from adjustment of discharge quantity of the high-pressure fuel supply pump 60 performed by a suction control valve 74. Thereby, the pressure reducing valve 41 can adjust the common rail pressure at a specific pressure. A fuel pipe 43, which communicates with a fuel tank 30, is connected with the pressure reducing valve 41. When the pressure reducing valve 41 opens, the fuel pipe 43 is opened. Then, the fuel accumulated in the common rail 40 flows through the fuel pipe 43 back to the fuel tank 30.

The fuel injection valves 50 are installed on the engine 2 to correspond to the cylinders so that the fuel can be supplied from the common rail 40 to combustion chambers of the engine 2. The fuel injection valves 50 are connected to the common rail 40 through high-pressure pipes 51. The control circuit 200 controls fuel injection timings and fuel injection quanitities of the fuel injection valves 50. A fuel pipe 52, which communicates with the fuel tank 30, is connected with the fuel injection valves 50. Of the fuel supplied from the common rail 40 to the fuel injection valves 50, excessive fuel that is not injected by the fuel injection valves 50 is returned to the fuel tank 30 through the fuel pipe 52.

The fuel supply apparatus 10 draws the fuel from the fuel tank 30, pressurizes the fuel, and supplies the pressurized fuel to the common rail 40 through a fuel pipe 42 that is connected with the common rail 40. The fuel supply apparatus 10 includes a fuel pump 20, a filter unit 80, the high-pressure fuel supply pump 60 and the suction control valve 74. The fuel pump 20 draws the fuel from the fuel tank 30 and preliminarily pressurizes the fuel. The filter unit 80 removes foreign matters contained in the fuel discharged from the fuel pump 20. The preliminarily pressurized fuel is supplied from the fuel pump 20 to the high-pressure fuel supply pump 60. The high-pressure fuel supply pump 60 further pressurizes the fuel, and pressure-feeds the fuel to the common rail 40. The suction control valve 74 adjusts quantity of the fuel supplied from the fuel pump 20 to the high-pressure fuel supply pump 60. In this embodiment, a pressure adjusting device (not shown) is attached to the fuel pump 20 to adjust discharge pressure of the fuel pump 20.

The high-pressure fuel supply pump 60 has a cam shaft 601, which acts as a drive shaft of the high-pressure fuel supply pump 60, and plungers 604. The cam shaft 601 rotates by receiving a drive force of a crankshaft (not shown) of the engine 2. The plungers 604 are driven by the cam shaft 601 and reciprocate in cylinders 607. The fuel is sucked and pressurized in accordance with reciprocating motions of the plungers 604, and the pressurized fuel is supplied to the common rail 40. The number of the plungers 604 is two or more (two in this embodiment). The plungers 604 are opposed to each other in a radial direction of the cam shaft 601 so that the plungers 604 suck and pressurize the fuel by turns.

The cam shaft 601 and the plungers 604 are accommodated in a pump housing (not shown). The cam shaft 601 has a cam 602 that rotates integrally with the cam shaft 601. The cam 602 is accommodated in a cam chamber 608 that is formed in the pump housing. A cam ring 603 is rotatably fitted to an outer circumference of the cam 602. A metal bush is interposed between the cam 602 and the cam ring 603.

The plungers 604 are supported by the cylinders 607 formed in the pump housing so that the plungers 604 can reciprocate. A tappet 605 is integrally formed on a cam shaft 601 side end portion of the plunger 604. A spring 606 pushes the tappet 605 onto an outer circumferential surface of the cam ring 603. When the cam shaft 601 rotates, the cam ring 603 transforms an eccentric rotation of the cam 602 into reciprocating linear motion, and the reciprocating liner motion is transmitted to the tappet 605. Thereby, the plungers 604 reciprocate in the cylinders 607.

A pressurizing chamber 609 is defined in each of the cylinders 607 so that a volume of the pressurizing chambers 609 changes in accordance with the reciprocating motion of the plungers 604. A suction passage 62 and a discharge passage 63 are connected to the pressurizing chamber 609.

A suction valve 621, which opens when the fuel is sucked into the pressurizing chamber 609, is installed in the suction passage 62. A discharge valve 631, which opens when the fuel is discharged from the pressurizing chamber 609, is installed in the discharge passage 63. The fuel pipe 42 connects the discharge passage 63 to the common rail 40.

When the plunger 604 moves toward the cam shaft 601 in the cylinder 607, the volume of the pressurizing chamber 609 increases, and pressure of the fuel in the pressurizing chamber 609 decreases. Thereby, the fuel, which is supplied from the fuel pump 20 to the suction passage 62, pushes the suction valve 621 open, and is sucked into the pressurizing chamber 609.

When the plunger 604 moves away from the cam shaft 601 in the cylinder 607, the volume of the pressurizing chamber 609 decreases, and the fuel sucked in the pressurizing chamber 609 is pressurized. After that, when the pressure of the fuel in the pressurizing chamber 609 exceeds a valve opening pressure of the discharge valve 631, the fuel in the pressurizing chamber 609 pushes the discharge valve 631 open, and is discharged to the common rail 40 through the discharge passage 63.

The fuel pump 20 is installed in the fuel tank 30. The fuel pump 20 is, for example, a conventional electromotive pump that is driven by electricity. The fuel pump 20 and the high-pressure fuel supply pump 60 correspond to a fuel injection pump in the claims. In this embodiment, the fuel pump 20 and the high-pressure fuel supply pump 60 are separately formed from each other, and the fuel pump 20 is not driven by the engine 2. Therefore, it is possible to control operation of the fuel pump 20 and it is possible to adjust discharge quantity of the fuel pump 20 irrespective of the running state of the engine 2. The fuel pump 20 and the high-pressure fuel supply pump 60 are not limited to the above-mentioned configuration. For example, the fuel pump 20 and the high-pressure fuel supply pump 60 may be configured as a supply pump, in which the fuel pump 20 and the high-pressure fuel supply pump 60 are driven by the engine 2 through a common pump drive shaft.

An inlet side (suction side) of the fuel pump 20 is not limited to a configuration provided with a pre-filter (not shown), which removes foreign matters contained in the fuel in the fuel tank 30. The fuel pump 20 may be configured without the pre-filter.

The fuel pump 20 is driven by being electrically energized, and discharges the fuel, which is drawn from the fuel tank 30, to the high-pressure fuel supply pump 60 through a fuel pipe 21. The filter unit 80 is installed in the fuel pipe 21 to remove foreign matters contained in the fuel.

The suction control valve 74 is an electromagnetic valve of which a valve opening degree is controlled by the control circuit 200 on a basis of the running state of the engine 2. The suction control valve 74 is installed in the suction passage 62. The control circuit 200 adjusts discharge quantity, that is, quantity of the fuel sucked into the pressurizing chambers 609 of the high-pressure fuel supply pump 60 by controlling the valve opening degree of the suction control valve 74. A fuel passage 75 is connected to a downstream side of the suction control valve 74. The fuel that leaks while the suction control valve 74 is closed is returned to a downstream side of the cam chamber 608 through the fuel passage 75.

A fuel passage 78 is connected with the suction passage 62. The fuel passage 78 extends from an upstream side of the suction control valve 74 to the cam chamber 608. A part of the fuel discharged from the fuel pump 20 is supplied through the fuel passage 78 to the cam chamber 608 as lubricant. The fuel supplied to the cam chamber 608 lubricates the cam 602, the plungers 604, etc. and returns to the fuel tank 30 through a fuel passage 64 and a fuel pipe 65. The fuel passage 78, the cam chamber 608, the fuel passage 64 and the fuel pipe 65 are not provided with what inhibits circulation of fuel such as a valve, so that the fuel can flow therethrough at all times while the fuel supply apparatus 10 is operating.

The fuel pipes 43, 52, 65, which are prepared for the pressure reducing valve 41, the fuel injection valves 50, the high-pressure fuel supply pump 60, respectively, correspond to an excessive fuel passage 99. Excessive fuel, which is returned from constituents of high-pressure system to the fuel tank 30, flows through the excessive fuel passage 99.

As shown in FIGS. 1, 2, 4, 5, 6, the filter unit 80 is located between the fuel pump 20 and the high-pressure fuel supply pump 60. The filter unit 80 removes foreign matters contained in the fuel discharged from the fuel pump 20, and supplies the fuel to the high-pressure fuel supply pump 60. The filter unit 80 includes a filter element 81, a jet pump 90, an open/close valve 93 that acts as the open/close means, a relief valve 95, a filter housing 89, etc.

The filter element 81 is constructed of nonwoven fabrics etc., for example, and is superior to the above-mentioned pre-filter in performance of removing foreign matters. In other words, size of holes in the filter element 81 (hereafter referred to as mesh), which allow passage of fine-grained particles such as foreign matters in the fuel supply apparatus 10, is smaller than size of mesh of the other pre-filter.

As shown in FIG. 1, a fuel passage 82, which communicates with the fuel pipe 21 of the fuel pump 20, is connected to an inlet side (upstream side) of the filter element 81. The fuel passage 82 corresponds to a fuel supply passage in the claims. A fuel passage 83 is connected to an outlet side (downstream side) of the filter element 81. The fuel passage 83 supplies the fuel to the suction passage 62 of the high-pressure fuel supply pump 60. A fuel pipe 84 connects a downstream end of the fuel passage 83 to the suction passage 62 of the high-pressure fuel supply pump 60.

Figure 4:
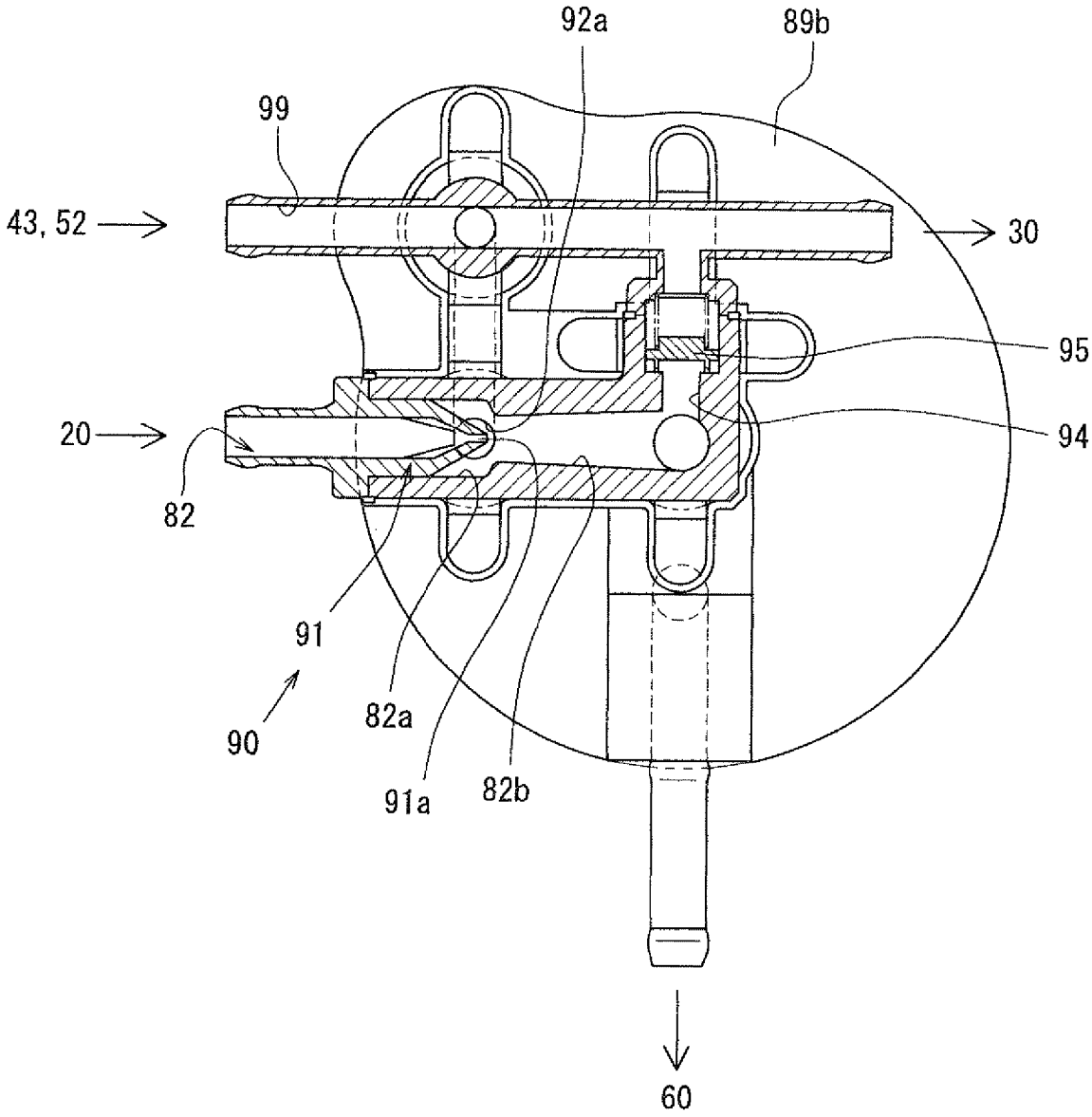
FIG. 4 is a cross-sectional view of the filter unit, taken along a line IV-IV of FIG. 2.

As shown in FIGS. 1, 4, the jet pump 90, which has a nozzle 91 is installed in the fuel passage 82. The jet pump 90 injects the fuel discharged from the fuel pump 20 (hereafter referred to as discharge fuel) out of the nozzle 91 in the fuel passage 82, and generates sucking force on a downstream side of the nozzle 91. By using this sucking force, the jet pump 90 introduces the fuel other than the discharge fuel to the downstream side of the nozzle 91.

Figure 5:
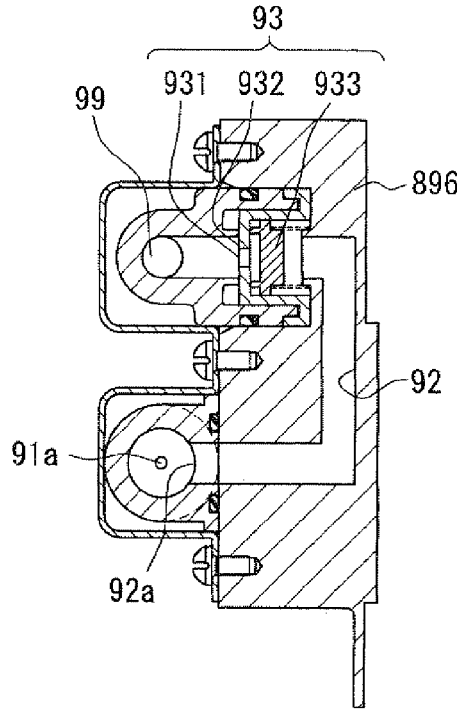
FIG. 5 is a cross-sectional view of the filter unit, taken along a line V-V of FIG. 3.

As shown in FIGS. 4, 5, in the above-mentioned jet pump 90, the nozzle 91 provides a conically shaped passage in the fuel passage 82. An injection port 91*a*, which acts as a flow restriction portion, is formed in a tip portion of the conically shaped passage in the nozzle 91. Furthermore, the jet pump 90 has an installation chamber 82*a* and a throat passage 82*b* on a downstream side of the nozzle 91 in the fuel passage 82. The nozzle 91 is installed in the installation chamber 82*a*. The throat passage 82*b* extends in a throat-like manner from a downstream end of the installation chamber 82*a*. The installation chamber 82*a* has a cylindrical shape that surrounds a circumference of the nozzle 91. The throat passage 82*b* has a cylindrical shape that extends forward in an axial direction of the nozzle 91. The nozzle 91 is installed in the installation chamber 82*a* so that a central axis of the nozzle 91 is coaxially aligned with a central axis of the installation chamber 82*a* and the throat passage 82*b*.

The installation chamber 82*a* generates negative pressure that acts as a source of the sucking force. The throat passage 82*b* supplies the discharge fuel, which is injected out of the injection port 91*a*, and the excessive fuel, which is introduced through an introducing passage 92 by the sucking force, to the filter element 81 that is located on a downstream side of the fuel passage 82. The installation chamber 82*a* corresponds to a downstream side of a nozzle in the claims.

As shown in FIGS. 1, 5, the introducing passage 92 connects the fuel passage 82 at the downstream side of the nozzle 91 to the excessive fuel passage 99. The open/close valve 93 is installed on a way of the introducing passage 92. The open/close valve 93 enables and disables flow of the fuel through the introducing passage 92. When the open/close valve 93 is opened, the downstream side of the nozzle 91 communicates with the excessive fuel passage 99 through the introducing passage 92. Thereby, when the discharge fuel of the fuel pump 20 is supplied to the jet pump 90, the sucking force is generated at the downstream side of the nozzle 91. Therefore, the relatively hot excessive fuel is introduced to the downstream side of the nozzle 91 by the sucking force. The open/close valve 93 corresponds to an open/close means in the claims.

As shown in FIGS. 5, 7, the open/close valve 93 opens and closes the introducing passage 92 in accordance with temperature of the fuel. The open/close valve 93 is installed in the introducing passage 92. The open/close valve 93 includes a valve element 931, a valve seat portion 932 and a check valve 933. The valve element 931 is constructed of a heat-sensing part such as a bimetal. The valve element 931 seats on and lifts off the valve seat portion 932. The check valve 933 is located on a downstream side of the valve seat portion 932.

As shown in FIG. 7B, the valve element 931 is thermally deformed in a specific temperature range (hereafter referred to as a first temperature range) to lift off the valve seat portion 932. As shown in FIG. 7A, the valve element 931 is restored to its original shape in another certain temperature range (hereafter referred to as a second temperature range), and the valve element 931 seats on the valve seat portion 932. As shown in FIG. 8, the first temperature range corresponds to a low temperature state where temperature of the excessive fuel is below T1 (22° C. or lower, for example). The second temperature range corresponds to a hot state where the temperature of the excessive fuel is above T2 (T2>T1). In the second temperature range, the temperature of the excessive fuel is 35° C. or higher, for example. Specifically, when the open/close valve 93 is in the high temperature state where the temperature of the excessive fuel is above T2, the open/close valve 93 is closed. After that, when the temperature of the excessive fuel has fallen to T1, the open/close valve 93 opens. Once the open/close valve 93 has opened, the open/close valve 93 remains opening while the valve element 931 is in the low temperature state where the temperature of the excessive fuel is below T1. When the temperature of the excessive fuel has risen up to T2, the open/close valve 93 opens.

When the temperature of the fuel is below the above-mentioned temperature T1, wax can precipitate out of the fuel drawn from the fuel tank 30. When the temperature of the fuel is T1 or lower, supply of the excessive fuel to the filter element 81 should be started under the operation of the fuel pump 20. When the temperature of the fuel is above the above-mentioned temperature T2, wax does not precipitate out of the fuel drawn from the fuel tank 30. When the temperature of the fuel is T2 or higher, supply of the excessive fuel to the filter element 81 may be stopped under the operation of the fuel pump 20. The temperature T1 and the temperature T2 correspond to a first predetermined temperature and a second predetermined temperature, respectively, in the claims.

When the valve element 931 lifts off the valve seat portion 932, the excessive fuel on an upstream side of the open/close valve 93 in the excessive fuel passage 99 is supplied to a downstream side of the valve seat portion 932, as indicated by arrows in FIG. 7B. Then, the excessive fuel supplied from the upstream side of the open/close valve 93 pushes the check valve 933 open, and the excessive fuel flows out toward the downstream side of the nozzle 91 in the fuel passage 82.

Figure 6:
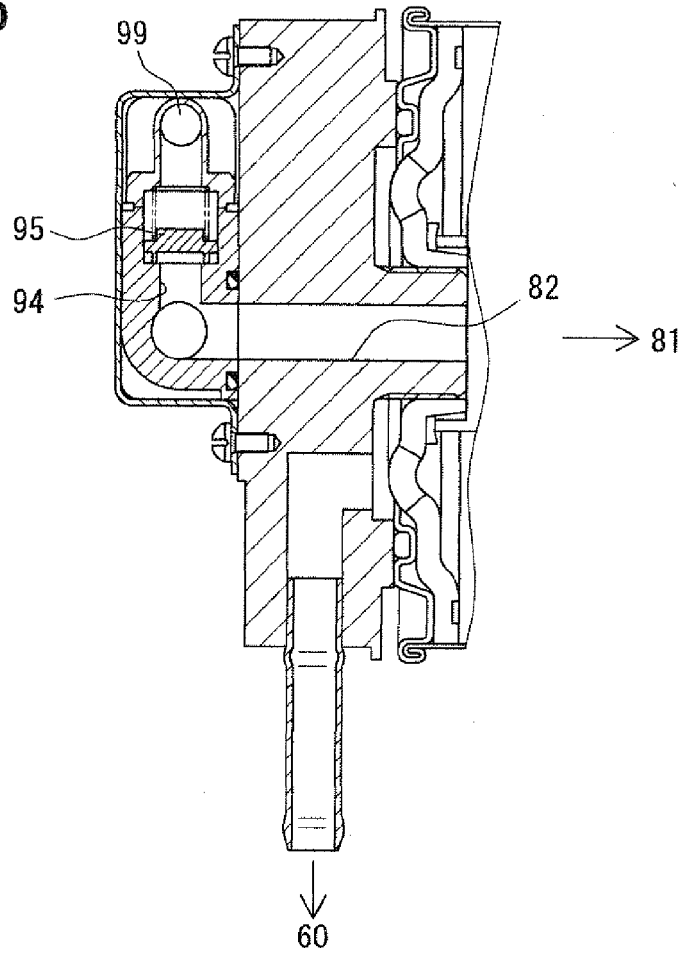
FIG. 6 is a cross-sectional view of the filter unit, taken along a line VI-VI of FIG. 3.

As shown in FIGS. 1, 4, 6, one end of a relief passage 94, which acts as a release passage, is connected to the downstream side of the jet pump 90 in the fuel passage 82. The other end of the relief passage 94 is connected with the excessive fuel passage 99 at a downstream side (fuel tank 30 side in FIG. 1) of a branch point where the introducing passage 92 branches off from the excessive fuel passage 99. The relief valve 95 is installed on a way of the relief passage 94. The relief valve 95 opens when pressure of the fuel on the upstream side of the filter element 81 exceeds a predetermined value. When the relief valve 95 is opened, a part of the fuel, which flows from the jet pump 90 to the filter element 81, is returned to the excessive fuel passage 99, specifically to the downstream side of the branch point where the introducing passage 92 branches off from the excessive fuel passage 99. At this time, the pressure of the fuel on the upstream side of the filter element 81 is maintained below a predetermined value. The relief passage 94 and the relief valve 95 correspond to a fuel flow rate adjusting device in the claims.

Figure 2:
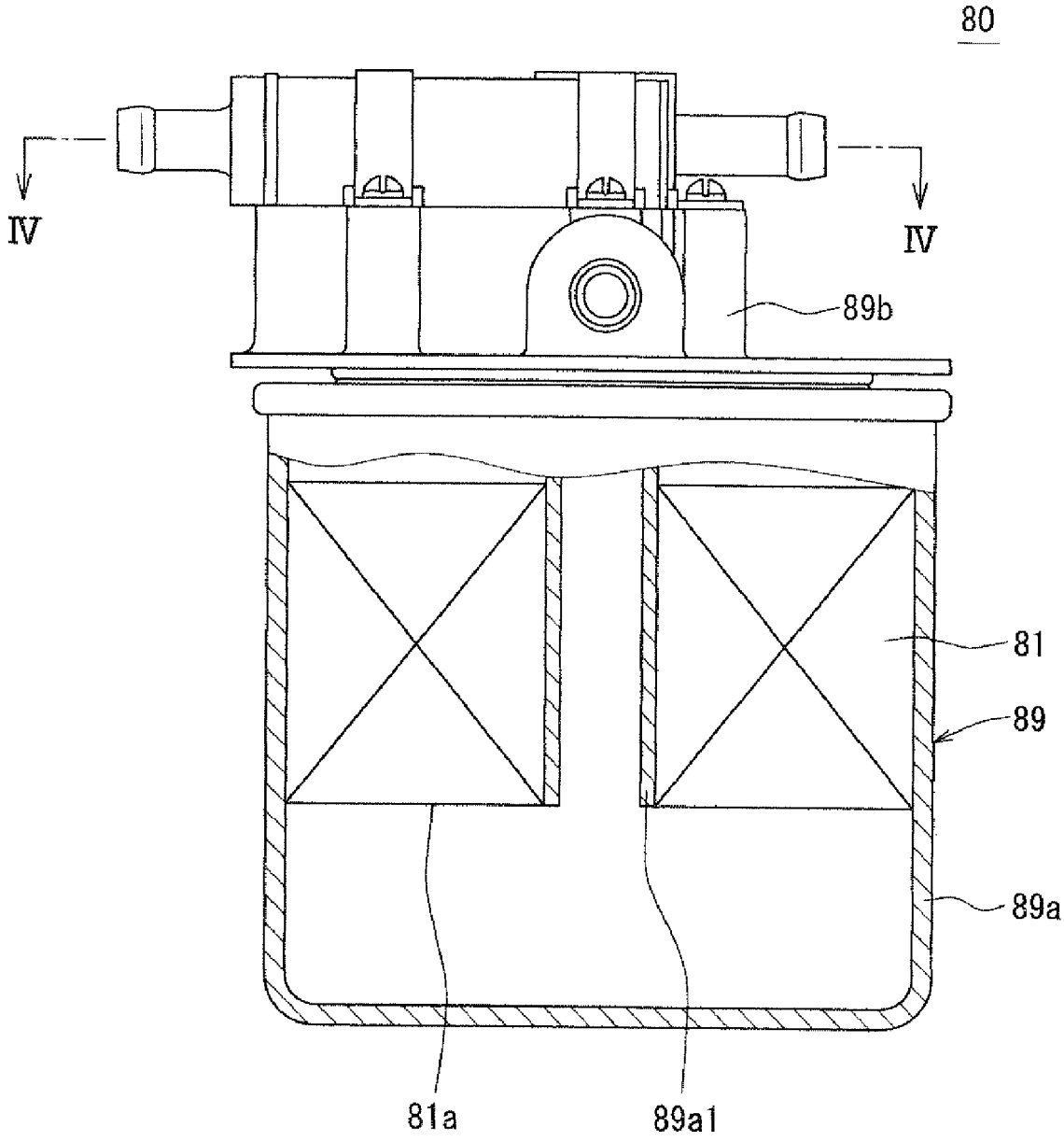
FIG. 2 is a partially cross-sectional side view showing a filter unit in FIG. 1, which includes a filter element and a jet pump.
Figure 3:
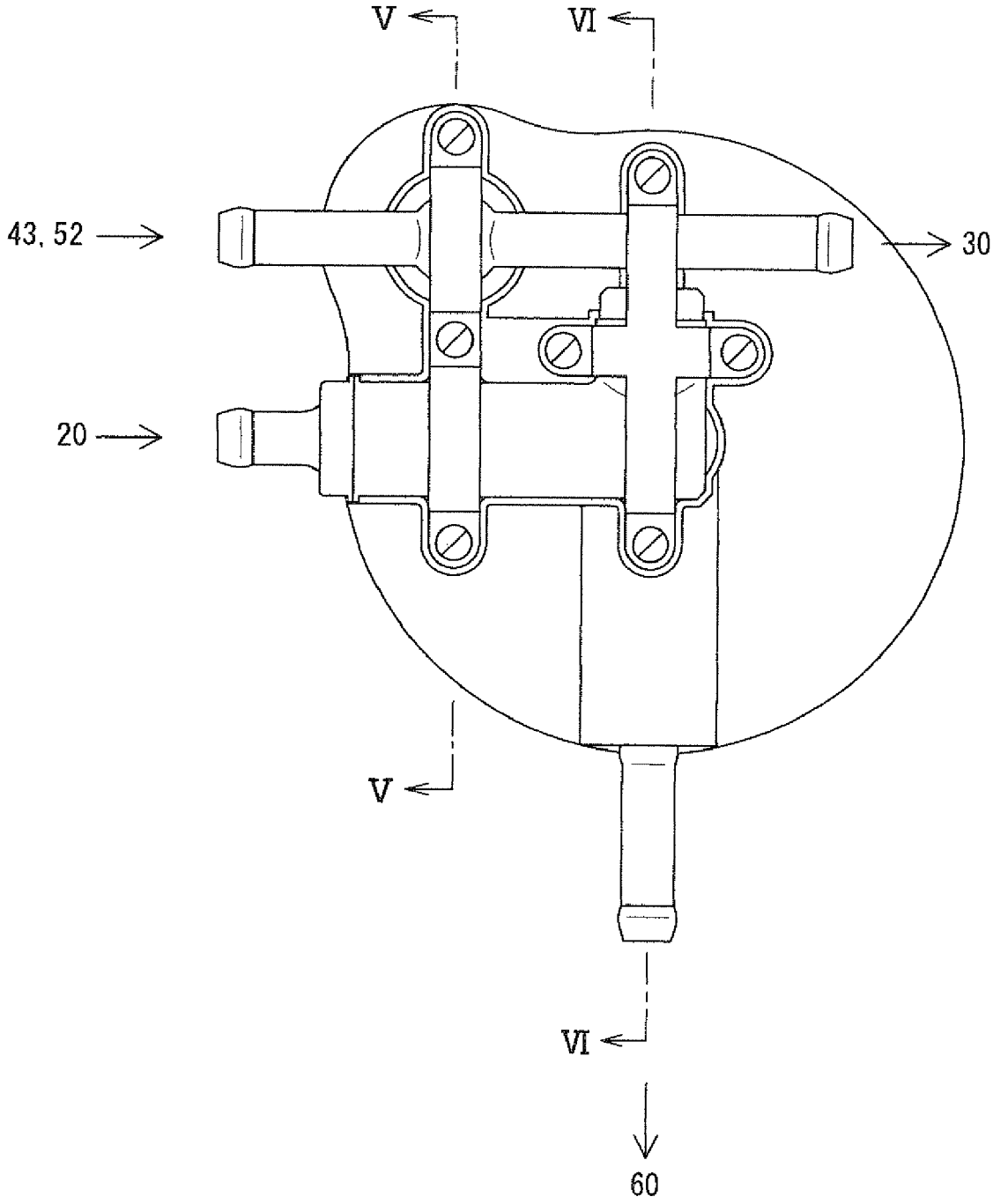
FIG. 3 is a top view showing the filter unit of FIG. 2.

As shown in FIGS. 2, 4, 5, the filter housing 89 includes a first housing 89*a* and a second housing 89*b*. The first housing 89*a* has a bottomed cylindrical shape. The second housing 89*b* blocks a top opening of the first housing 89*a*. As shown in FIG. 2, the first housing 89*a* accommodates and holds the filter element 81 therein. The first housing 89*a* has an internal passage 89*a*1 that penetrates the filter element 81. When the fuel flows into the filter unit 80, the fuel flows through the internal passage 89*a*1 in a downward direction in FIG. 2. Then, the flow of the fuel turns in a bottom portion of the first housing 89*a*, and the fuel flows further in an upward direction in FIG. 2 to a filter surface 81*a* of the filter element 81.

As shown in FIGS. 4, 5, 6, the fuel passage 82, the introducing passage 92 and the relief passage 94 are formed in the second housing 89*b*.

As shown in FIGS. 4, 6, the relief passage 94 connects a downstream side of the throat passage 82*b*, which leads to the filter element 81, to the excessive fuel passage 99. The fuel passage 82 and the excessive fuel passage 99 communicate with each other through the relief valve 95.

As shown in FIGS. 4, 5, the introducing passage 92 connects the installation chamber 82*a* to the excessive fuel passage 99, specifically to an upstream side of a branch point where the relief passage 94 branches off from the excessive fuel passage 99. The fuel passage 82 and the excessive fuel passage 99 communicate with each other through the open/close valve 93. An opening 92*a* of the introducing passage 92, that is, an installation chamber 82*a* side opening of the introducing passage 92 is positioned in a proximity of the injection port 91*a* of the nozzle 91.

A construction of the fuel supply apparatus 10 according to this embodiment has been described above. Operation of the fuel supply apparatus 10 will be described hereafter. The operation of the fuel supply apparatus 10 will be described for each of a time when the engine 2 is stopped, a time when the engine 2 is started, and a time when the engine 2 is normally running.

When the engine 2 is running, the excessive fuel returns into the fuel in the fuel tank 30. Thereby, the excessive fuel is cooled by the fuel reserved in the fuel tank 30 (hereafter referred to as reservoir fuel), and the reservoir fuel is heated by the excessive fuel. Accordingly, wax does not precipitate out of the discharge fuel of the fuel pump 20.

After that, when the engine 2 is stopped, the control circuit 200 stops operations of the high-pressure fuel supply pump 60, the common rail 40 and the fuel injection valves 50. Thereby, a reflow of the excessive fuel to the fuel tank 30 is stopped, and the temperature of the reservoir fuel falls.

The excessive fuel passage 99 always communicates with the fuel tank 30. Therefore, after the engine 2 is stopped, the fuel in the excessive fuel passage 99 flows into the fuel tank 30. Thereby, the open/close valve 93, which is installed in the introducing passage 92 of the filter unit 80, comes out from immersion in the excessive fuel, and the temperature of the valve element 931 falls.

If the temperature of the valve element 931 has fallen below the temperature T1 in accordance with a temperature of atmospheric air surrounding the valve element 931, the valve element 931 is deformed by heat-sensing function, and the valve element 931 lifts off the valve seat portion 932. Namely, the open/close valve 93 opens. At this time, the check valve 933 is closed. Therefore, the atmospheric air in the excessive fuel passage 99 does not flow into the fuel passage 82 that leads to the filter element 81. By this check valve 933, it is possible to prevent intrusion of air into the fuel passage 82 that leads to the filter element 81 even when the open/close valve 93 is opened while the engine 2 is stopped.

When the temperature of the atmospheric air is above the temperature T1, the open/close valve 93 closes not when the temperature exceeds the temperature T1 but when the temperature reaches the temperature T2. Wax does not precipitate out of the fuel when the engine 2 is started under the condition where the temperature of the atmospheric air is above the temperature T2.

In the following description, it is assumed that the engine 2 is stopped and started under a condition where the temperature of the atmospheric air is below the temperature T2 and the open/close valve 93 can open. In the following description, the operation of the fuel supply apparatus 10 is not described about the time when the engine 2 is started after the engine 2 has been stopped under the condition where the temperature of the atmospheric air is above the temperature T2.

When the engine 2 is started, the control circuit 200 drives and controls the fuel pump 20, the high-pressure fuel supply pump 60, the common rail 40 and the fuel injection valves 50. Thereby, the fuel pump 20 and the high-pressure fuel supply pump 60 operate. The fuel pump 20 preliminary pumps the fuel, and the high-pressure fuel supply pump 60 pressure-feeds the fuel.

The discharge fuel of the fuel pump 20 flows into the fuel passage 82 of the filter unit 80 through the fuel pipe 21. The fuel flowed into the fuel passage 82 is introduced to the nozzle 91 of the jet pump 90, and is injected out of the injection port 91*a* of the nozzle 91. The fuel injected from the injection port 91*a* flows into the throat passage 82*b* through the installation chamber 82*a*. At this time, the injection of fuel out of the injection port 91*a* generates the negative pressure, which acts as the source of the sucking force, in the installation chamber 82*a*. Cross-section of area of a fuel flow passage is gradually extended as going forward in the throat passage 82*b*. Therefore, the fuel injected from the injection port 91*a* recovers to a state of flowing across an entire of the cross-sectional area of the throat passage 82*b*, and the pressure of the fuel recovers to a value corresponding to the pressure of the discharge fuel on the upstream of the nozzle 91.

In other words, the discharge fuel of the fuel pump 20 has the negative pressure and generates the sucking force only in a limited section of the fuel passage 82, that is, only on the downstream side of the nozzle 91 (only in the installation chamber 82*a*). When the sucking force is generated in the installation chamber 82*a*, the excessive fuel, which flows through the excessive fuel passage 99 and has positive pressure, pushes the check valve 933 open, and the excessive fuel flows into the installation chamber 82*a* through the introducing passage 92.

The discharge fuel of the fuel pump 20 and the excessive fuel, which has flowed through the introducing passage 92, merge with each other in the installation chamber 82*a*, and are supplied to the downstream side of the throat passage 82*b*.

The above-mentioned discharge fuel and the excessive fuel, which are merged with each other in the installation chamber 82*a* by the sucking force, will be hereafter referred to as transfer fuel, which is transferred by the nozzle 91.

The transfer fuel is formed by merging the discharge fuel of the fuel pump 20 with the relatively hot excessive fuel. Therefore, the transfer fuel, which is supplied to the filter element 81 through the throat passage 82*b*, can introduce the excessive fuel to a filtering area on an inlet side of the filter element 81 with reliability. Thereby, the temperature of the fuel in the filtering area on the inlet side of the filter element 81 is raised, and it is possible to avoid clogging of the filter element 81, which is caused by wax that precipitates out of the fuel when the temperature of the fuel is relatively cold.

As a way to raise the temperature of the fuel on the inlet side of the filter element 81, the excessive fuel, which is transferred by the sucking force of the nozzle 91, is introduced to the inlet side of the filter element 81. Therefore, it is not necessary to provide the filter unit 80, which has the filter element 81, with a heat source such as an electric heater. That is, external devices such as parts of a heat source are not especially required.

The excessive fuel can be introduced to the inlet side of the filter element 81 as a part of the above-mentioned transfer fuel. Therefore, it is possible to bring the excessive fuel directly to the filter element 81, and it is possible to directly heat the filter surface 81*a* of the filter element 81, which contacts with the filtering area. Furthermore, while the filter element 81 is filtering the transfer fuel, the excessive fuel can raise the temperature of the fuel that passes through the filter element 81. Accordingly, it is possible to raise the temperature of the fuel in the filtering area on the inlet side of the filter element 81 and to raise the temperature of the filter element 81 itself.

When the engine 2 is normally running without causing an engine stall, pressure of the high-pressure fuel, which is accumulated in the common rail 40 and is supplied to the fuel injection valves 50, is set to a target rail pressure, which corresponds to a target fuel injection pressure appropriate for the running state. Then, the high-pressure fuel supply pump 60 pressure-feeds the high-pressure fuel at high temperature.

While the engine is normally running as mentioned above, the temperature of the excessive fuel rises. When the temperature of the excessive fuel has risen up to the temperature T2, the open/close valve 93 closes. As a result, the excessive fuel having temperature higher than the temperature T2 is not supplied to the filter element 81 and the high-pressure fuel supply pump 60 through the introducing passage 92.

In the above-described first embodiment, the nozzle 91 is installed in the fuel passage 82 between the fuel pump 20 and the filter element 81 that is located on a downstream side of the fuel pump 20. The jet pump 90 generates the sucking force on the downstream side of the nozzle 91 by injecting fuel out of the injection port 91*a* of the nozzle 91 into the fuel passage 82. In addition to the above-mentioned construction, the introducing passage 92 is provided on the downstream side of the nozzle 91 (in the installation chamber 82*a*) where the above-mentioned sucking force is generated. The introducing passage 92 introduces the excessive fuel flowing in the excessive fuel passage 99 to the fuel passage 82.

By this construction, the sucking force, that is, the negative pressure is generated on the upstream side of the filter element 81 by the jet pump 90. By this sucking force, the excessive fuel, which has higher temperature than the above-mentioned discharge fuel (the fuel in the fuel tank 30), can be introduced to the inlet side of the filter element 81 through the introducing passage 92. Thereby, the excessive fuel contacts with the inlet side of the filter element 81, and it is possible to raise the temperature of the fuel that flows through the filter element 81. Therefore, it is possible to avoid clogging of the filter element 81 caused by precipitated wax.

Furthermore, even if the discharge fuel of the fuel pump 20 contains solid wax that has precipitated in low temperature, the temperature of the fuel on the inlet side of the filter element 81 is raised by the excessive fuel. Therefore, it is possible to reduce the above-mentioned solid wax that has precipitated in low temperature. Therefore, it is possible to resolve clogging of the filter element 81 caused by precipitated wax.

Furthermore, as a way to raise the temperature of the fuel at the inlet side of the filter element 81, the excessive fuel, which is transferred by the sucking force of the nozzle 91, is introduced to the inlet side of the filter element 81. Therefore, it is not necessary to provide the filter unit 80, which has the filter element 81, with a heat source such as an electric heater. That is, external devices such as parts of a heat source are not especially required.

Moreover, in the above-described first embodiment, the fuel pump 20 is configured to be installed in the fuel tank 30.

In such a configuration, the fuel pump 20 is immersed in the fuel in accordance with a liquid level of the fuel reserved in the fuel tank 30, and the fuel pump 20 is cooled by the fuel. Therefore, the fuel discharged from the fuel pump 20 is not influenced so much by heat generated by the operation of the fuel pump 20, and the temperature of the discharge fuel is not heated so much. However, as described above, the sucking force is generated on the upstream side of the filter element 81 by the jet pump 90, and this sucking force introduces the excessive fuel to the inlet side of the filter element 81 through the introducing passage 92. Therefore, it is possible to introduce the excessive fuel, which has higher temperature than the fuel in the fuel tank 30, to the filtering area on the inlet side of the filter element 81 with reliability. Therefore, it is possible to inhibit clogging of the filter element 81.

Moreover, in the above-described first embodiment, the open/close valve 93 is installed in the introducing passage 92. The open/close valve 93 enables and disables flow of the excessive fuel between the excessive fuel passage 99, in which the excessive fuel flows, and the installation chamber 82*a* in the fuel passage 82 (downstream side of the nozzle 91). The open/close valve 93 is configured to open the introducing passage 92 in the low temperature state where the temperature of the fuel is below the first temperature T1.

If the excessive fuel is introduced to the inlet side of the filter element 81 through the introducing passage 92 at all times irrespective of the temperature at which wax precipitates out of fuel, a part of the excessive fuel or a whole of the excessive fuel does not return to the fuel tank 30 at all times. In this case, the fuel, which circulates through constituents of the high-pressure fuel system such as the high-pressure fuel supply pump 60 and the fuel injection valves 50, can be excessively heated.

However, in this embodiment having the above-mentioned construction, the introducing passage 92 is provided with the open/close valve 93. The open/close valve 93 enables the flow of the excessive fuel into the installation chamber 82*a* only in the low temperature state where the temperature of the fuel is below the first temperature T1. Therefore, it is possible to avoid a situation in which the excessive fuel does not return to the fuel tank 30 at all times as mentioned above. Accordingly, it is possible to inhibit excessive temperature rise of the fuel that circulates through the constituents of the above-mentioned high-pressure fuel system.

Moreover, in the above-described first embodiment, the valve element 931 of the open/close valve 93, which senses the temperature of the fuel, is constructed of a heat-sensing part such as a bimetal, and has a heat-sensing function. The valve element 931 has a heat-sensing function to seat on and lift off the valve seat portion 932 by sensing the temperature of the excessive fuel.

By sensing the temperature of the excessive fuel with a single fuel temperature sensing means, that is, the valve element 931, it is possible to determine whether the temperature of the discharge fuel of the fuel pump 20 is in a range where wax can precipitate out of fuel and whether the fuel circulating through the constituents of the high-pressure fuel system is excessively heated. Accordingly, it is possible to simplify the construction of the fuel supply apparatus 10.

In the engine 2 provided with the fuel supply apparatus 10 having the above-mentioned construction, the temperature of the discharge fuel of the fuel pump 20 and the temperature of the excessive fuel, which has flowed out of the constituents of the high-pressure fuel system, have a certain correlation to each other, in accordance with specifications of the fuel supply apparatus 10 and the constituents 40, 50, 60 of the high-pressure fuel system. Therefore, it is possible to determine whether the fuel circulating through the constituents of the high-pressure fuel system is excessively heated on a basis of the temperature of the excessive fuel.

In determining whether the temperature of the fuel (temperature of the excessive fuel) is at a certain temperature at which precipitated wax can clog in the filter element 81, there is an apprehension that the clogging of the precipitated wax in the filter element 81 is not always inhibited just by raising the temperature of the fuel above the certain temperature. If clogging of the filter element 81 occurs, flow rate of the fuel supplied to the internal combustion engine decreases, causing engine stall etc. Therefore, normal running state of the engine 2 may not be maintained in case of clogging of the filter element 81.

However, in this embodiment, the first temperature T1 and the second temperature T2 are set. The first temperature T1 is a preset temperature for starting introducing the excessive fuel to the upstream side of the filter element 81. The second temperature T2 is a preset temperature for stopping introducing the excessive fuel to the upstream side of the filter element 81. A temperature difference (T2–T1) is reserved between the first temperature T1 and the second temperature T2. Therefore, it is possible to inhibit clogging of the precipitated wax in the filter element 81 without fail. Accordingly, it is possible to secure normal running of the engine 2.

In the above-described embodiment, it is desirable that the fuel flow rate adjusting device is installed between the jet pump 90 and the filter element 81. The fuel flow rate adjusting device has the relief valve 95 that adjust a flow rate of the transfer fuel, which is transferred by the jet pump 90 and is supplied to the filter element 81.

When the temperature of fuel is in the range where wax can precipitate out of the fuel, the precipitated wax decreases the flow rate of the fuel flowing from the filtering area on the inlet side of the filter element 81 to the downstream side of the filter element 81, and the clogging of the filter element 81 develops. If the flow rate of the fuel passing through the filter element 81 becomes smaller than a flow rate required for circulating through the constituents of the above-mentioned high-pressure fuel system, the normal running of the engine 2 cannot be maintained.

In this regard, in this embodiment having the above-mentioned construction, it is possible to limit the flow rate of the fuel passing through the filter element 81 to a certain flow rate larger than the above-mentioned required flow rate. Therefore, it is possible to extend a time until the flow rate of the fuel passing through the filter element 81 becomes smaller than the required flow rate. In other words, it is possible to extend a time until it becomes unable to supply required amount of the fuel. By effectively using this time, the wax that precipitates in low temperature can be reduced by the excessive fuel, which is a part of the transfer fuel that contains the excessive fuel and the discharge fuel of the fuel pump 20 and is transferred by the jet pump 90. Accordingly, it is possible to raise the temperature of the fuel to a temperature range in which wax does not precipitate out of the fuel. Therefore, it is possible to effectively avoid a situation where the normal running state of the engine 2 cannot be stably maintained.

It is desirable that the above-mentioned fuel flow rate adjusting device includes the relief passage 94 and the relief valve 95. The relief passage 94 branches off from the fuel passage 82 between the nozzle 91 of the jet pump 90 and the filter element 81, and returns the fuel toward the fuel tank 30. The relief valve 95 opens the relief passage 94 in accordance with the pressure of the fuel in the relief passage 94.

By this configuration, it is possible to simplify the construction of the fuel flow rate adjusting device. The fuel flow rate adjusting device having the relief valve 95 can detect the state where the clogging of the filter element 81 has developed and it has become unable to supply the required amount of the fuel, by using pressure change, that is, pressure loss at the filter element 81. What is necessary is just to configure the relief valve 95 to open when the pressure change is within a permissible range.

With regard to a relation between the above-mentioned fuel flow rate adjusting device and the filter element 81, it is desirable to arrange the relief passage 94 and the filter element 81 in the filter unit 80. By this configuration, the heat of the excessive fuel, which flows through the relief passage 94 opened by the relief valve 95, is transferred to the second housing 89*b* in the filter unit 80. Therefore, of the transfer fuel that is transferred by the jet pump 90, the excessive fuel can indirectly heat the filter element 81.

In the above-described first embodiment, the jet pump 90 and the filter element 81 are arranged in the filter unit 80. In the fuel supply apparatus 10 having this configuration, at least a part of the introducing passage 92, through which the jet pump 90 introduces the excessive fuel, is arranged in the filter unit 80. Therefore, the jet pump 90 introduces the excessive fuel to the upstream side of the filter element 81, and the filter element 81 is directly heated. In addition, the heat of the excessive fuel, which flows through the introducing passage 92 that is arranged in the filter unit 80, is transferred to the second housing 89*b* in the filter unit 80, and the excessive fuel can indirectly heat the filter element 81.

Furthermore, in the above-described first embodiment, the jet pump 90 is fitted to the filter housing 89. Therefore, the excessive fuel, which is introduced by the jet pump 90, can be introduced directly to the inlet side of the filter element 81 as the transfer fuel. Moreover, the excessive fuel indirectly heats the filter element 81 through the second housing 89*b* of the filter housing 89, and the filter element 81 can be effectively heated.

In the above-described first embodiment, the fuel supply apparatus 10 is applied to a high-pressure fuel system that includes the fuel injection valves 50 and the common rail 40 as its constituents. The fuel injection valves 50 are installed on the engine 2 for respective cylinders, and inject the fuel into the cylinders. The common rail 40 is located between the fuel pump 20 and the fuel injection valves 50. The common rail 40 accumulates pressurized fuel therein, and supplies the pressurized fuel to the fuel injection valves 50. Of the excessive fuel that flows out from the constituents of the high-pressure fuel system, at least the excessive fuel that flows out from specific constituents 40, 50 of the high-pressure fuel system can be used as the excessive fuel that is introduced to the filter element 81 by the sucking force generated by the jet pump 90. In other words, total amount of the excessive fuel, which flows out from the constituents of the above-mentioned high-pressure fuel system, always exceeds an amount of the excessive fuel that flows out from the specific constituents 40, 50. Therefore, the supply of the excessive fuel is not interrupted. The sucking force of the jet pump 90 introduces the excessive fuel effectively to the upstream side of the filter element 81, and it is possible to effectively raise the temperature of the fuel that passes through the filter element 81.

Second Embodiment

Figure 9:
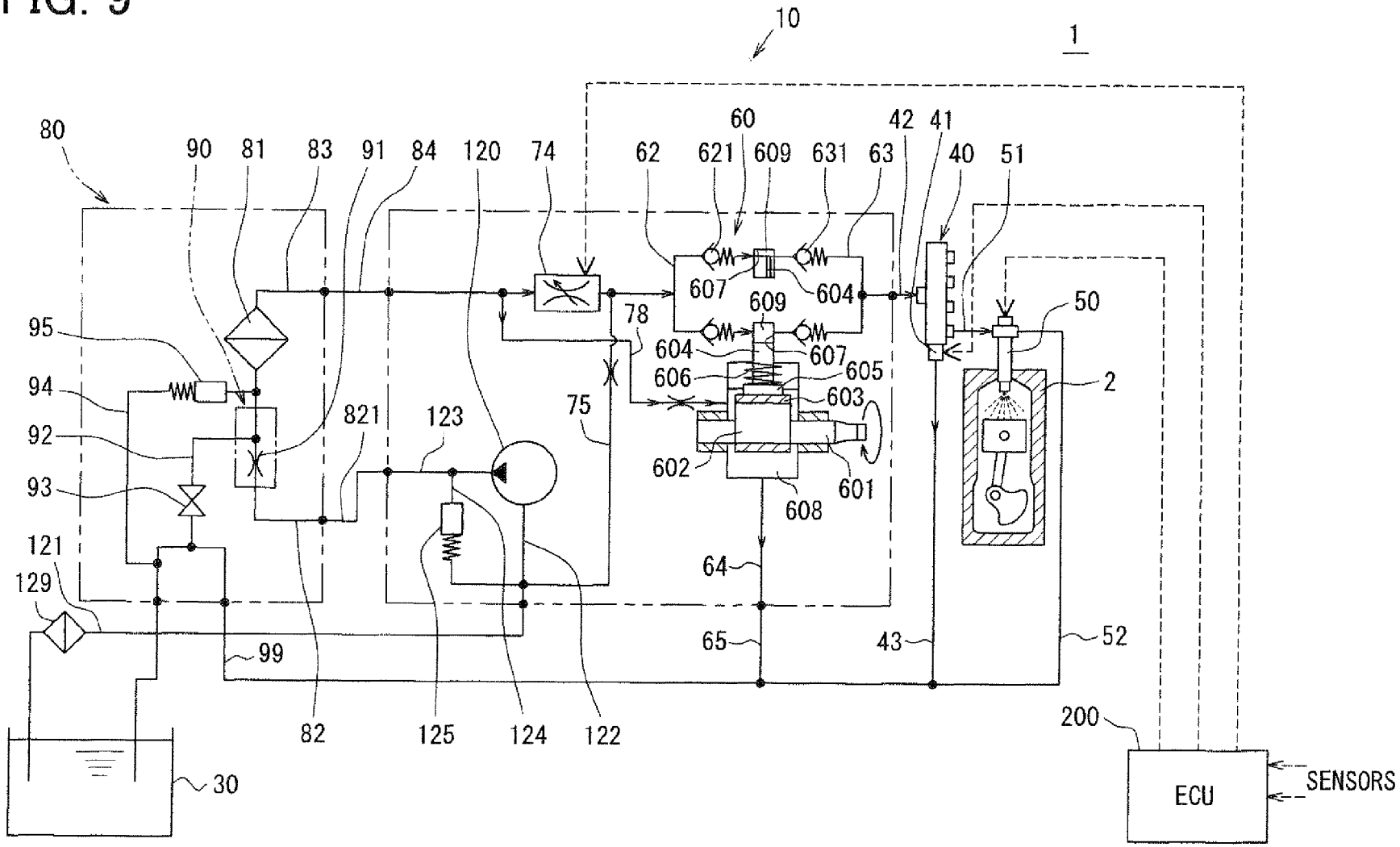
FIG. 9 is a schematic diagram showing a construction of an accumulator fuel injection apparatus that includes a fuel supply apparatus according to a second embodiment of the present invention.

FIG. 9 shows a construction of an accumulator fuel injection apparatus that includes a fuel supply apparatus 10 according to a second embodiment of the present invention. The second embodiment is a modification of the first embodiment. In the second embodiment, a fuel pump 120 is not installed in a fuel tank 30. The fuel supply apparatus 10 according to the second embodiment has a configuration in which the fuel pump 120 and a high-pressure fuel supply pump 60 are driven by an engine 2 through a common pump drive shaft 601.

The fuel pump 120 and the high-pressure fuel supply pump 60 are integrated into a supply pump, which corresponds to a fuel injection pump in the claims. The fuel pump 120 and the high-pressure fuel supply pump 60 are driven by turning force of a crankshaft of the engine 2. When the engine 2 is stopped, operations of the fuel pump 120 and the high-pressure fuel supply pump 60 stop.

The fuel pump 120 is, for example, a conventional trochoid pump, and is accommodated in a pump housing together with the high-pressure fuel supply pump 60. The fuel pump 120 is driven by the pump drive shaft (camshaft) 601, and discharges the fuel, which is drawn from the fuel tank 30, to the high-pressure fuel supply pump 60 through a fuel pipe 121. A pre-filter 129 is installed in the fuel pipe 121 to remove foreign matters contained in the fuel.

A suction passage 122, which is connected with the fuel pipe 121, communicates with an inlet side (suction side) of the fuel pump 120. A gauze filter (not shown) is installed in the suction passage 122 to remove foreign matters contained in the fuel on a downstream side of the pre-filter 129.

A discharge passage 123 communicates with an outlet side (discharge side) of the fuel pump 120. The discharge passage 123 supplies the fuel, which is discharged from the fuel pump 120, to a filter unit 80. A fuel pipe 821 connects a downstream end of the discharge passage 123 to a fuel passage 82 of the filter unit 80

A fuel passage 124 connects the suction passage 122 to the discharge passage 123 in the fuel pump 120. The inlet side of the fuel pump 120 communicates with the outlet side of the fuel pump 120 through the fuel passage 124. A pressure adjusting device 125 is installed in the fuel passage 124 to adjust discharge pressure of the fuel pump 120.

A filter element 81 is superior to the above-mentioned pre-filter 129 and the gauze filter in performance of removing foreign matters. In other words, size of mesh in the filter element 81, which allows passage of fine-grained particles such as foreign matters in the fuel supply apparatus 10, is smaller than size of mesh of the other pre-filter and the gauze filter.

A fuel passage 75 is connected to the suction passage 122 of the fuel pump 120. The fuel that leaks while a suction control valve 74 is closed is returned to the inlet side of the fuel pump 120 through the fuel passage 75. Thereby, it is possible to improve discharge efficiency of the fuel pump 120.

The fuel supply apparatus 10 according to the second embodiment, which has the above-described configuration, brings substantially the same effects as the fuel supply apparatus 10 according to the first embodiment.

In the second embodiment having the above-described configuration, the fuel pump 120 and the high-pressure fuel supply pump 60 are integrated into a supply pump. It is difficult to install the supply pump in the fuel tank 30, since the fuel is heated and pressurized in the high-pressure fuel supply pump 60. Therefore, the supply pump is installed outside of the fuel tank 30 on a side of the engine 2. The supply pump having such a construction can raise temperature of the discharge fuel of the fuel pump 120 by using heat generated by its operation. Therefore, even when the engine 2 is started in a cold time, the discharge fuel of the fuel pump 120 can be easily heated by the operation of the supply pump that is driven by the engine 2.

As described above, the fuel pump 120 and the high-pressure fuel supply pump 60 are driven by the engine 2 through the common pump drive shaft 601. In such a supply pump, the fuel pump 120 and the high-pressure fuel supply pump 60 are integrated with the pump drive shaft 601, and are accommodated in the supply pump.

In such a construction, when the supply pump starts its operation, the heat generated by the high-pressure fuel supply pump 60 can heat both of the fuel pump 120 and the discharge fuel of the fuel pump 120. If a technology according to the present invention, which introduces relatively hot excessive fuel to an inlet side of the filter element 81 by using a jet pump 90, is applied to this construction, it is possible to rapidly raise the temperature of the fuel that passes through the filter element 81. Therefore, it is possible to effectively inhibit clogging of the filter element 81 caused by precipitated wax.

Third Embodiment

Figure 10:
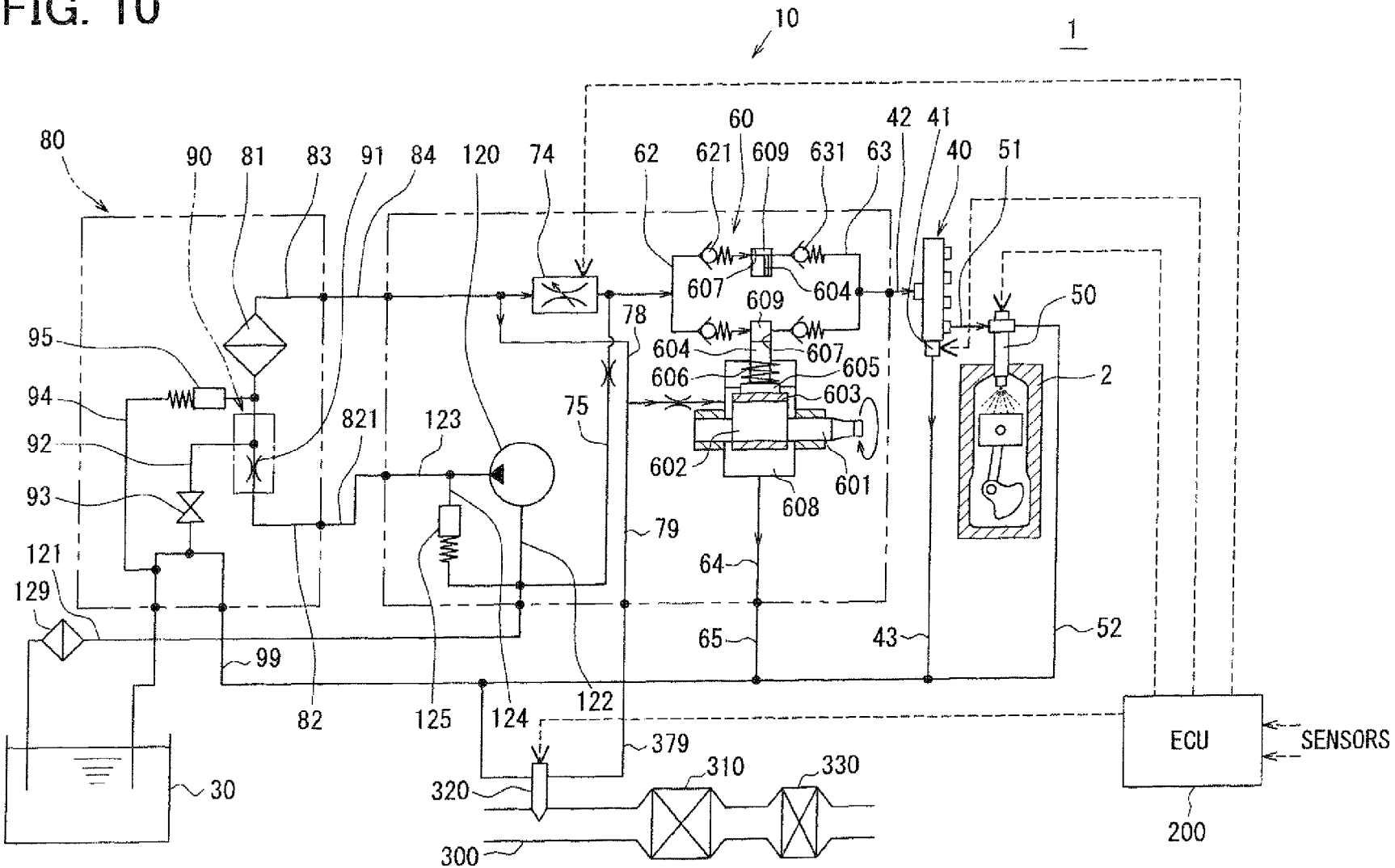
FIG. 10 is a schematic diagram showing a construction of an accumulator fuel injection apparatus that includes a fuel supply apparatus according to a third embodiment of the present invention.

FIG. 10 shows a construction of an accumulator fuel injection apparatus that includes a fuel supply apparatus 10 according to a third embodiment of the present invention. The third embodiment is a modification of the second embodiment. The fuel supply apparatus 10 according to the third embodiment is provided with a fuel addition valve 320. The fuel addition valve 320 is used for an exhaust filter (hereafter referred to as a DPF) 310 that purifies exhaust gas, and is installed on an exhaust passage 300 of an engine 2. The fuel addition valve 320 injects fuel that is supplied from a supply pump to an upstream side of the DPF 310 in the exhaust passage 300.

The DPF 310, which collects fine particles in the exhaust gas, is installed in the exhaust passage 300 of the engine 2. A NOx catalyst device 330, which occludes NOx in the exhaust gas, is installed on a downstream side of the DPF 310 in the exhaust passage 300.

The fuel addition valve 320 is installed on the upstream side of the DPF 310 in the exhaust passage 300. The fuel addition valve 320 is a conventional injection valve in which an electromagnetic solenoid actuates a needle that opens and closes an injection hole. A fuel inlet portion of the fuel addition valve 320 is connected to one end portion of a fuel pipe 379, which is connected with an additive fuel supply passage 79 that is branched off from a fuel passage 78 of the supply pump. A fuel discharge portion of the fuel addition valve 320 is connected to an excessive fuel passage 99 through the other end portion of the fuel pipe 379.

When the fuel is relatively cold, a control circuit 200 restricts injection of the fuel from the fuel addition valve 320, and increases excessive fuel that is discharged from the fuel discharge portion of the fuel addition valve 320.

According to this construction, the fuel addition valve 320 is installed in the exhaust passage 300 of the engine 2. The fuel addition valve 320 injects a part of pressurized fuel to the upstream side of the DPF 310 in the exhaust passage 300. It is possible to use a part of the pressurized fuel as the excessive fuel that is introduced to a filter element 81 by sucking force generated by a jet pump 90.

In addition to the above-mentioned construction, the control circuit 200 has a function that increases the excessive fuel discharged from the discharge portion of the fuel addition valve 320 when the fuel is relatively cold. Thereby, it is possible to increase a flow rate of the excessive fuel by restricting addition of the fuel in the fuel addition valve 320 when the fuel is relatively cold. Accordingly, it is possible to give a higher priority to raising the flow rate of the excessive fuel, which is used for heating the filter element 81, when the fuel is relatively cold, by temporarily restricting the addition of the fuel in the fuel addition valve 320.

Other Embodiments

Embodiments of the present invention are described above. However, the present invention is not limited to the above-described embodiments. Various changes may be made without departing from the scope of the invention.

(1) In the above described embodiments, the fuel pump 20, 120 is an electromotive pump or a mechanically driven pump. The fuel pump in the present invention may be either one of an electromotive pump and a mechanically driven pump.

(2) In the above-described embodiments, the open/close valve 93, which opens and closes the introducing passage 92, is constructed of a heat-sensing part such as a bimetal. Alternatively, the open/close means in the present invention may be an electromagnetic valve device that is driven and controlled by the control circuit 200.

(3) In the above-described embodiments, the constituents of the high-pressure fuel system, from which the excessive fuel flows out, include the high-pressure fuel supply pump 60, the common rail 40 and the fuel injection valves 50. The excessive fuel that flows in the excessive fuel passage 99 may be supplied from all of the high-pressure fuel supply pump 60, the common rail 40 and the fuel injection valves 50. The excessive fuel may be supplied from a specific constituent(s) of the high-pressure fuel system. It is sufficient if the excessive fuel is supplied from at least one of the constituents of the high-pressure fuel system.

(4) The control circuit 200 may be configured to drive the pressure reducing valve 41 of the common rail 40 to increase the excessive fuel when the fuel is relatively cold.

By this construction, the flow rate of the excessive fuel that flows through the filter element 81 can be easily raised by setting the target rail pressure at a low pressure and setting the fuel pressure in the common rail 40 lower than in a normal running time of the engine 2. When the engine 2 is started under low temperature condition, it is not necessary to raise the above-mentioned fuel pressure, that is, the injection pressure of the fuel injected from the fuel injection valves 50 above the fuel pressure in the normal running time of the engine 2. Therefore, it is possible to rapidly raise the temperature of the fuel at the inlet side of the filter element 81 when the engine 2 is started under the low temperature condition. Thereby, it is possible to effectively inhibit clogging of the filter element 81 caused by wax precipitated out of the fuel.

Additional advantages and modifications will readily occur to those skilled in the art. The invention in its broader terms is therefore not limited to the specific details, representative apparatus, and illustrative examples shown and described.

What is claimed is:

1. A fuel supply apparatus for supplying fuel from a fuel tank to a high-pressure fuel system that accumulates the fuel at a high pressure, supplies the fuel to an internal combustion engine at the high pressure, and returns excessive fuel, which is a part of the fuel that is once accumulated in the high-pressure fuel system yet not supplied to the internal combustion engine, to the fuel tank, the apparatus comprising:

a fuel pump that draws the fuel from the fuel tank and discharges the fuel to the high-pressure fuel system;

a filter unit that has a filter element located on a downstream side of the fuel pump to remove foreign matters contained in the fuel discharged from the fuel pump;

a jet pump that has a nozzle installed in a fuel supply passage between the fuel pump and the filter element to inject the fuel to a downstream side of the nozzle in the fuel supply passage; and an introducing passage that introduces the excessive fuel from the high-pressure fuel system to the downstream side of the nozzle.

2. The fuel supply apparatus according to claim 1, wherein the fuel pump is installed in the fuel tank.

3. The fuel supply apparatus according to claim 1, wherein:

the high-pressure fuel system includes a high-pressure fuel supply pump that pressurizes the fuel discharged from the fuel pump; and the fuel pump and the high-pressure fuel supply pump are integrated in a fuel injection pump.

4. The fuel supply apparatus according to claim 3, wherein:

the fuel pump and the high-pressure fuel supply pump are driven by a common drive shaft that is rotated by the internal combustion engine; and the jet pump and the introducing passage are located between the fuel pump and the high-pressure fuel supply pump.

5. The fuel supply apparatus according to claim 1, wherein:

the introducing passage is provided with an open/close means that enables and disables passage of the excessive fuel flowing from the high-pressure fuel system to the downstream side of the nozzle; and the open/close means opens the introducing passage when temperature of the fuel is lower than a first predetermined temperature.

6. The fuel supply apparatus according to claim 5, further comprising a fuel temperature detecting device that detects temperature of the excessive fuel, wherein the open/close means opens the introducing passage when the temperature of the excessive fuel detected by the fuel temperature detecting device is lower than the first predetermined temperature.

7. The fuel supply apparatus according to claim 5, wherein the open/close means closes the introducing passage when the temperature of the fuel is higher than a second predetermined temperature that is higher than the first predetermined temperature.

8. The fuel supply apparatus according to claim 1, wherein a fuel flow rate adjusting device is installed between the jet pump and the filter element in the fuel supply passage to adjust a flow rate of the fuel that is transferred by the jet pump and is supplied to the filter element.

9. The fuel supply apparatus according to claim 8, wherein the fuel flow rate adjusting device includes:

a release passage that is branched off from the fuel supply passage at a point between the jet pump and the filter element to return a part of the fuel from the fuel supply passage to the fuel tank; and a relief valve that opens and closes the release passage, and wherein the relief valve opens the release passage in accordance with pressure of the fuel in the release passage.

10. The fuel supply apparatus according to claim 9, wherein the release passage and the filter element are located in the filter unit.

11. The fuel supply apparatus according to claim 1, wherein the jet pump and the filter element are located in the filter unit.

12. The fuel supply apparatus according to claim 11, wherein:

the filter unit includes a filter housing that accommodates the filter element therein; and the jet pump is fitted to the filter housing.

13. The fuel supply apparatus according to claim 1, wherein the high-pressure fuel system includes:

a fuel injection valve that is installed on the internal combustion engine to inject the fuel into a cylinder of the internal combustion engine; and a common rail that is located between the fuel pump and the fuel injection valve, accumulates the fuel at the high pressure and supplies the fuel to the fuel injection valve, and wherein the excessive fuel is supplied from at least one of the fuel injection valve and the common rail.

14. The fuel supply apparatus according to claim 13, wherein the common rail is provided with a pressure reducing valve that reduces pressure of the fuel in the common rail by increasing the excessive fuel that flows out from the common rail.

15. The fuel supply apparatus according to claim 1, further comprising a fuel addition valve that is located in an exhaust passage of the internal combustion engine and injects a part of the fuel accumulated in the high-pressure fuel system to an upstream side of a catalyst device in the exhaust passage to purify exhaust gas of the internal combustion engine.

16. The fuel supply apparatus according to claim 15, further comprising a control means that restricts injection of the fuel by the fuel addition valve to increase the excessive fuel when a temperature of the fuel is relatively low.

* * * * *